US005662313A

United States Patent [19]

Forrester

[11] Patent Number: 5,662,313

[45] Date of Patent: Sep. 2, 1997

[54] BARB ARM EXTENSION

[76] Inventor: Joseph H. Forrester, P.O. Box 505, Buford, Ga. 30518

[21] Appl. No.: 616,508

[22] Filed: Mar. 19, 1996

[51] Int. Cl.[6] ..... E04H 17/00

[52] U.S. Cl. ..... 256/11; 256/32; 256/65

[58] Field of Search ..... 256/2, 3, 4, 5, 256/6, 7, 8, 9, 11, 12, 65, 58

[56] References Cited

U.S. PATENT DOCUMENTS

| | | | |
|---|---|---|---|
| 1,237,601 | 8/1917 | Arthur | 256/11 |
| 1,401,509 | 12/1921 | Bailey | 256/11 |
| 1,440,852 | 1/1923 | Thomson | 256/11 |
| 1,460,936 | 7/1923 | Bailey | 256/11 |
| 1,773,519 | 7/1930 | Cox . | |
| 1,839,898 | 1/1932 | Skinner | 256/11 |
| 2,161,944 | 6/1939 | Bauer | 256/11 |
| 3,028,147 | 4/1962 | Crumbo | 256/11 |
| 3,084,913 | 4/1963 | Cox | 256/11 |
| 3,428,300 | 2/1969 | Sconzo . | |
| 3,749,368 | 7/1973 | Miller . | |
| 3,771,767 | 11/1973 | Dougherty . | |
| 4,065,103 | 12/1977 | Sweezey . | |
| 4,159,820 | 7/1979 | Parisien | 256/11 |
| 4,408,748 | 10/1983 | Lewis | 256/11 |
| 4,602,764 | 7/1986 | Cacicedo | 256/11 |
| 4,603,840 | 8/1986 | Simkin . | |

*Primary Examiner*—Kenneth J. Dorner
*Assistant Examiner*—Bruce A. Lev
*Attorney, Agent, or Firm*—Shoemaker and Mattare, Ltd.

[57] ABSTRACT

A barb arm extension assembly is provided for retrofitting an existing anchor fence with barbed wire. The assembly includes a main body comprising an arm having means for retaining at least one strand of barbed wire and a first half-shell clamp member for engaging a first side of a fence post. A hinged bracket provides a second half-shell clamp member for engaging a second side of the post. Each of the half-shell clamp members has a central portion with an internal diameter sufficient to contain one of said caps without contacting it, and a necked-down bottom portion for engaging the post without disturbing either the post cap of the rail retained by the post cap.

4 Claims, 3 Drawing Sheets

BARB ARM EXTENSION

BACKGROUND OF THE INVENTION

This invention relates to barriers, and more particularly to an extension arm for supporting barbed wire at the top of a chain link fence or the like.

To deter would-be intruders from scaling a chain link fence, it is common to top such a fence with a few rows of barbed wire. To make scaling even more difficult, the wire is often supported by arms or extensions which are angled inward or outward, or both, with respect to the plane of the fence.

Prior inventors developed a variety of extension arms for attachment to existing fence posts.

Cox's U.S. Pat. No. 1,773,519 disclosed an arm which could pivot "universally" (actually, only two rotational degrees of freedom were provided) to vary the arm angle.

Subsequently, Miller (U.S. Pat. No. 3,749,368), noting the extreme difficulty work crews have in installing barb arms on fences having top rails, proposed an improvement to facilitate the insertion or replacement of top rails, without disrupting the entire fence. Miller acknowledged Sconzo, U.S. Pat. No. 3,428,300, which disclosed a fence post cap made in two interlocking halves to permit installation about an existing top rail.

U.S. Pat. Nos. 4,603,840, 4,065,103 and 3,771,767 are of additional interest to this invention.

Despite the efforts of prior inventors, installation of barbed wire extension arms to fences remains a difficult task. Additionally, many prior devices can fail or be defeated by applying enough force to them. Some devices, for example, attach to the top rail, which itself may rotate within the post caps.

In both U.S. Pat. Nos. 4,065,103 and 4,603,840, the means of attachment is designed to contact only the fence post. In either case, the limited surface area in contact between the attachment and the existing fence post is detrimental to strength and rigidity. The present invention, in contrast, provides a substantial contact width around the entire periphery of the post.

SUMMARY OF THE INVENTION

An object of the invention is to simplify the installation of barbed wire extension arms on chain link fences, or other fences having top rails.

Another object of the invention is to reduce the cost of extension arm kits for existing fences.

A related objective is to lower the costs of retrofitting a fence with barbed wire.

One further object is to improve the effective strength of add-on barbed wire extension arms, to prevent unauthorized bending, removal and the like.

These and other objects are attained by a barb arm extension for retrofitting an existing anchor fence with barbed wire.

The assembly includes a main body comprising an arm having means for retaining at least one strand of barbed wire and a first half-shell clamp member for engaging a first side of a fence post. A hinged bracket provides a second half-shell clamp member for engaging a second side of the post.

Each of the half-shell clamp members has a central portion with an internal diameter sufficient to contain one of the existing fence post caps without contacting it, and a necked-down bottom portion for engaging the post just below the cap, without disturbing either the post cap of the rail retained by the post cap.

The present invention eliminates the need to remove and replace any existing fence parts, and thus results in a substantially less expensive installation. The invention provides a new barb arm design, which substitutes a moveable, hinged bracket for that portion of current arms which are permanently attached to the main body portion by welding to form a one-piece unit. The dimensions of the present invention with respect to the upper portion of the barb arm body which hold the strands of wire are similar to prior device, but the lower portion is configured so as to fit over the existing top eye and top rail of each line posted when the hinged bracket is closed. Therefore, the entire unit may be secured firmly in the field, without disassembling the existing fence.

BRIEF DESCRIPTION OF THE DRAWINGS

In the accompanying drawings.

DESCRIPTION OF THE PREFERRED EMBODIMENT

Figure 4:
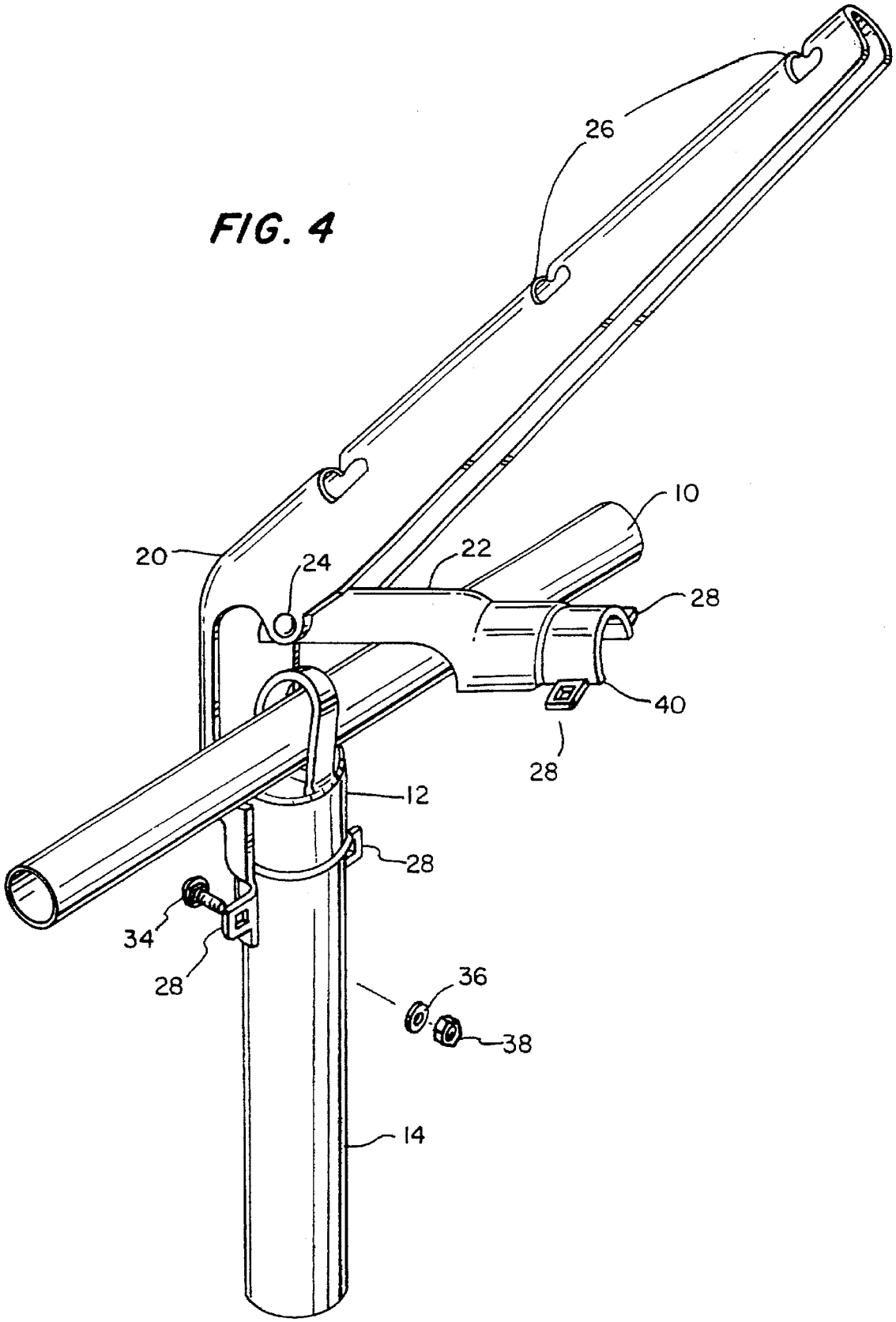
FIG. 4 is an isometric view of the arm as it is being installed on the fence.

FIG. 4 shows a fence, including a top rail 10, a post cap 12, and a fence post 14 to which the barb arm assembly is attached. The anchor fence mesh is not illustrated. The arm assembly includes two major components: an arm 20 and a bracket 22 hinged to the arm by means of a bolt 24, which is passed through holes in the arm and the bracket, and is secured by means of a fastener such as a nut. The arm and bracket may be pre-assembled at the factory, or prior to arrival at the work site. Both parts may be stamped from steel stock or other sheet metal, and preferably are galvanized or otherwise protected against corrosion.

The arm has at least one (preferably three, as shown) slots 26 for receiving strands of barbed wire (not shown). The slots shown are conventional, being oriented diagonally, so that wire can be easily inserted when it is slack, but cannot be removed after it has been tightened.

Figure 1:
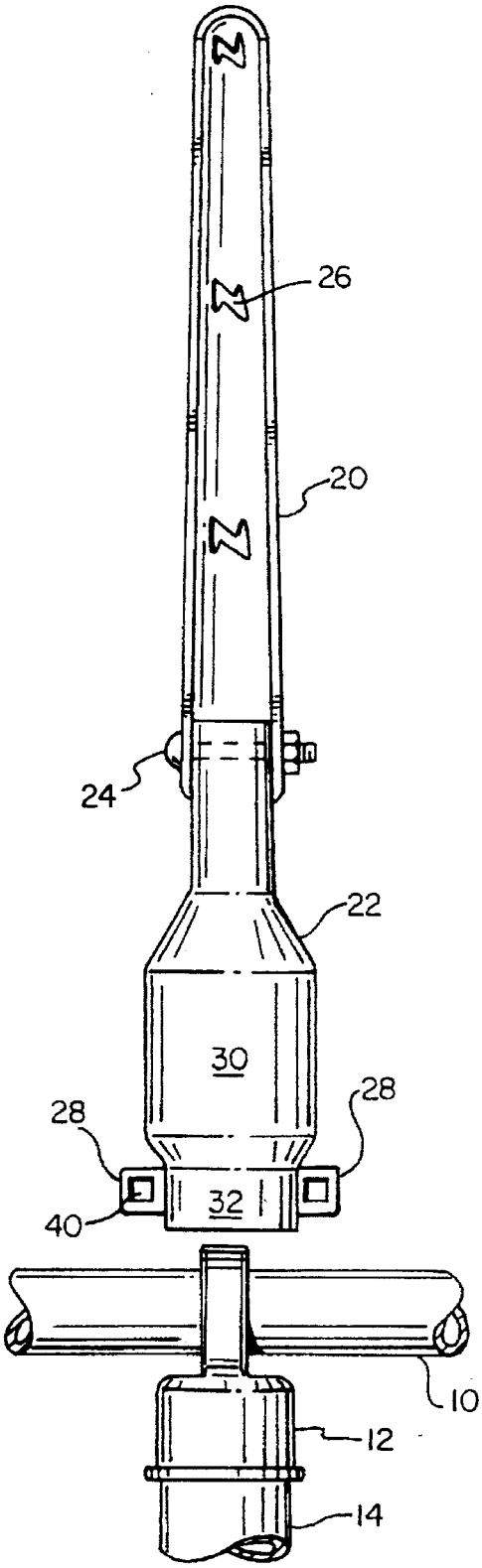
FIG. 1 is an exploded from view of a chain link fence post and top rail, and a barb arm extension embodying the invention.
Figure 3:
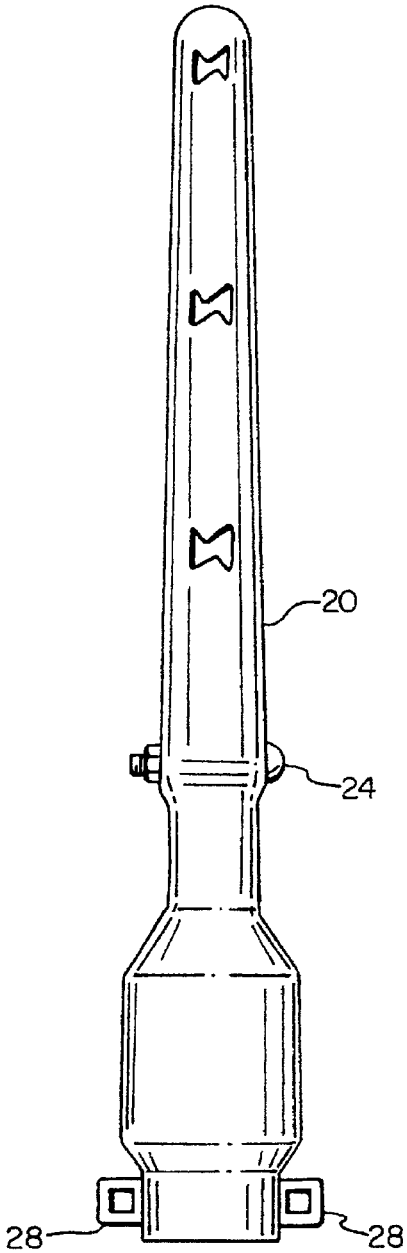
FIG. 3 is a rear elevation thereof.
Figure 2:
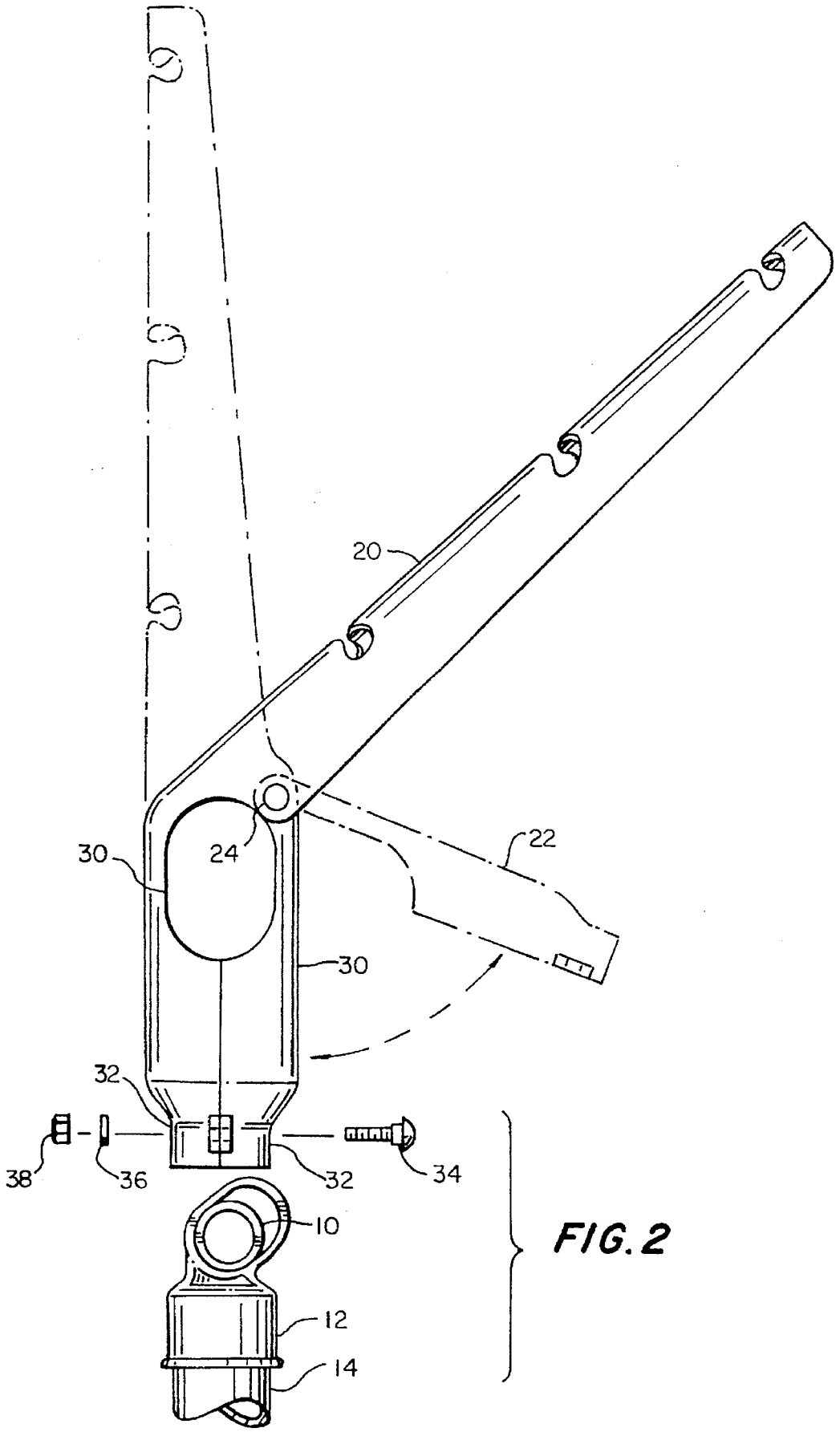
FIG. 2 is an exploded side elevation thereof.

As one can see in FIGS. 1 and 2, both the lower portion of the arm and the bracket are substantially cylindrical, each having a central portion 30 with an inside diameter sufficient to clear an existing anchor fence post cap, and a necked-down portion 32 at the bottom (below the cap) whose diameter about equal to that of a standard post.

Both the arm 20 and the bracket 22 have tabs 28 protruding laterally from their necked-down bottom portions. The tabs of the opposing parts are constructed to mate along a vertical plane on or near the post axis when the bracket is closed around the post.

To install the barb arm assembly, one merely opens the hinge connection so that the bracket is in the position illustrated in FIG. 4, and places the necked-down portion 32 of the half shell against one side of the post (the fencing, not shown, will be understood to run vertically below the top rail 6). The bracket is then swung downward until its necked-down portion engages the opposite side of the post.

The installer then inserts a fastener 34 such as a carriage bolt through each of the aligned holes in the tabs, and installs a washer 36 and a nut 38. The holes 40 in at least some of the tabs may be square, conforming to the shape of the bolt shank. As the nuts are tightened, great clamping force is developed, making the arm structurally one with the post. The height of the necked-down portion is substantial—preferably at least an inch—so that the clamping force is well distributed and a particularly rigid connection results.

An important advantage of this present device is that it can be installed right over existing fence post caps, so that neither the cap, the post, nor the top rail need be disturbed by the installation crew, and neither of those parts bears any part of the barb arm load. The clamping is directly against the post, not the top rail or the cap, and therefore the arm cannot rotate about the post axis or the rail axis. This feature is best seen in FIG. 4.

A number of variations of the invention described above will occur to those in this field. For example, the parts might be made from a material other than metal, or by a process other than stamping. One could also alter the details of the arm-to-post clamping structure, without departing from the invention in its broadest sense.

Since the invention is subject to modifications and variations, it is intended that the foregoing description and the accompanying drawings shall be interpreted as only illustrative of the invention defined by the following claims.

I claim:

1. In combination with an anchor fence having round metal fence posts, a tubular top rail, and caps mounted on the posts for supporting the top rail, a barb arm extension assembly comprising a main body comprising an arm having means for retaining at least one strand of barbed wire and a first half-shell clamp member for engaging a first side of said post only below said cap, a bracket in the form of a second half-shell clamp member for engaging a second side of said post opposite said first side, each of said half-shell clamp members having lateral cutouts to clear the top rail of the fence, a central portion with an internal diameter sufficient to contain one of said caps without contacting it, and a semicylindrical necked-down bottom portion having an internal diameter about equal to that of each of said posts, a hinge connection between the main body and the bracket, said hinge connection being formed respectively at the top of the bracket and at a point on the main body intermediate said arm and said first half-shell, and means for drawing said first and second half shells together to clamp the post between them below the post cap so as to avoid contact with either the post cap or the top rail.

2. The invention of claim 1, wherein the necked-down bottom portion has an internal diameter at least 20% less than said central portion.

3. The invention of claim 1, wherein said means for drawing said first and second half shells together comprises a pair of tabs extended laterally on either side of each said necked-down portion, and a fastener for drawing said tabs toward one another.

4. The invention of claim 3, wherein each said fastener comprises a nut and bolt, said tabs having holes through which said bolts are passed.

* * * * *